US012251014B2

(12) United States Patent
French

(10) Patent No.: US 12,251,014 B2
(45) Date of Patent: Mar. 18, 2025

(54) RACK SYSTEMS

(71) Applicant: Pipp Mobile Storage Systems, Inc., Walker, MI (US)

(72) Inventor: Thomas A. French, Grand Haven, MI (US)

(73) Assignee: Pipp Mobile Storage Systems, Inc., Walker, MI (US)

( * ) Notice: Subject to any disclaimer, the term of this patent is extended or adjusted under 35 U.S.C. 154(b) by 0 days.

(21) Appl. No.: 18/505,813

(22) Filed: Nov. 9, 2023

(65) Prior Publication Data

US 2024/0156253 A1 May 16, 2024

Related U.S. Application Data

(60) Provisional application No. 63/383,414, filed on Nov. 11, 2022.

(51) Int. Cl.

| | |
|---|---|
| ***A47B 47/02*** | (2006.01) |
| ***A47B 57/40*** | (2006.01) |
| ***A47B 87/02*** | (2006.01) |
| ***A47B 96/02*** | (2006.01) |
| *A47B 47/00* | (2006.01) |
| *A47B 57/20* | (2006.01) |
| *A47B 57/22* | (2006.01) |
| *A47B 57/30* | (2006.01) |
| *A47B 57/48* | (2006.01) |
| *A47B 57/50* | (2006.01) |
| *A47F 7/00* | (2006.01) |

(52) U.S. Cl.

CPC ..... *A47B 47/027* (2013.01); *A47B 57/40* (2013.01); *A47B 87/0215* (2013.01); *A47B 96/024* (2013.01); *A47B 47/0083* (2013.01); *A47B 47/021* (2013.01); *A47B 57/20* (2013.01); *A47B 57/22* (2013.01); *A47B 57/30* (2013.01); *A47B 57/48* (2013.01); *A47B 57/50* (2013.01); *A47B 87/0207* (2013.01); *A47F 7/0078* (2013.01)

(58) Field of Classification Search

CPC ..... A47B 47/027; A47B 96/024; A47B 57/40; A47F 7/0078

See application file for complete search history.

(56) References Cited

U.S. PATENT DOCUMENTS

| | | | |
|---|---|---|---|
| 1,360,669 | A | 11/1920 | Nielsen |
| 2,524,246 | A | 10/1950 | Young |
| 2,940,218 | A | 6/1960 | Carter |
| 3,024,569 | A | 3/1962 | Nearing et al. |

(Continued)

FOREIGN PATENT DOCUMENTS

| | | |
|---|---|---|
| WO | 2013120140 | 8/2013 |
| WO | 2015027267 | 3/2015 |

(Continued)

OTHER PUBLICATIONS

Brochure entitled "Mobile Rack Trays" by Bontanicare, believed to have been published on or before Oct. 1, 2020.

*Primary Examiner* — Devin K Barnett

(74) *Attorney, Agent, or Firm* — Gardner, Linn, Burkhart & Ondersma LLP

(57) ABSTRACT

Storage and grow rack systems include splice joints for stacking and joining upright posts, structural support beams with integral drainage, and studs or rivets providing releasable attachment of cross members to upright posts.

14 Claims, 12 Drawing Sheets

(56) References Cited

U.S. PATENT DOCUMENTS

| | | | | |
|---|---|---|---|---|
| 3,314,192 | A | 4/1967 | Park | |
| 3,608,240 | A | 9/1971 | Gunn | |
| D244,115 | S | 4/1977 | Dilyard | |
| 4,052,816 | A | 10/1977 | Perez | |
| 4,837,973 | A | 6/1989 | Snekkenes | |
| 4,934,858 | A * | 6/1990 | Beaulieu | F16B 12/40 403/174 |
| 5,337,517 | A | 8/1994 | Karthauser et al. | |
| 5,409,510 | A | 4/1995 | Houweling | |
| 5,425,198 | A | 6/1995 | Coy | |
| 5,533,954 | A | 7/1996 | Zogg | |
| 5,673,511 | A | 10/1997 | Holtkamp, Jr. | |
| 5,974,733 | A | 11/1999 | Gyory | |
| 6,138,403 | A | 10/2000 | Bartlett, Jr. | |
| 6,243,985 | B1 | 6/2001 | Miller | |
| 6,401,944 | B1 | 6/2002 | Kircher et al. | |
| D465,349 | S | 11/2002 | Sharpton, III | |
| 6,601,342 | B2 | 8/2003 | Dümmen | |
| 7,082,718 | B2 | 8/2006 | Dümmen | |
| 7,093,391 | B2 | 8/2006 | Eakin | |
| 7,156,243 | B2 | 1/2007 | Henning et al. | |
| 7,228,978 | B2 * | 6/2007 | Cross | A47B 96/021 211/153 |
| 7,637,056 | B2 | 12/2009 | Tajima et al. | |
| 7,891,507 | B2 * | 2/2011 | Shetler | A47B 55/00 211/135 |
| 8,555,547 | B2 | 10/2013 | Hashimoto et al. | |
| D698,182 | S | 1/2014 | Schall | |
| 8,720,110 | B2 | 5/2014 | Hayes et al. | |
| 8,910,419 | B1 | 12/2014 | Oberst | |
| D724,357 | S * | 3/2015 | Lim | A47B 47/047 D6/675.1 |
| 8,984,808 | B2 | 3/2015 | Daniels et al. | |
| 9,004,298 | B2 | 4/2015 | Sichello | |
| 9,017,552 | B2 | 4/2015 | Peters, Jr. et al. | |
| 9,032,664 | B2 | 5/2015 | Yuisbov et al. | |
| D732,323 | S | 6/2015 | Ho et al. | |
| D734,958 | S | 7/2015 | Gosling et al. | |
| D762,402 | S | 8/2016 | Hsu | |
| D764,205 | S | 8/2016 | Macari et al. | |
| 9,468,156 | B2 | 10/2016 | Sichello | |
| 9,468,294 | B2 * | 10/2016 | Fu | A47B 57/34 |
| 9,844,188 | B2 | 12/2017 | Legerton | |
| 9,854,750 | B2 | 1/2018 | Brusatore | |
| 10,238,046 | B2 | 3/2019 | Wu et al. | |
| 10,750,858 | B1 * | 8/2020 | Barre | A47B 45/00 |
| D906,876 | S | 1/2021 | Roecker et al. | |
| D925,392 | S | 7/2021 | Roecker et al. | |
| 11,116,148 | B1 * | 9/2021 | French | A01G 9/1476 |
| 11,202,502 | B1 * | 12/2021 | Berry | A47B 47/0083 |
| 11,997,963 | B1 * | 6/2024 | French | A01G 9/247 |
| 12,041,898 | B2 * | 7/2024 | Romine | A01G 9/023 |
| 2003/0159344 | A1 | 8/2003 | Vandewiele et al. | |
| 2004/0222178 | A1 | 11/2004 | Sparkowski | |
| 2006/0048469 | A1 | 3/2006 | MacLean et al. | |
| 2006/0162246 | A1 | 7/2006 | Okabe et al. | |
| 2006/0168886 | A1 | 8/2006 | McNulty et al. | |
| 2008/0023426 | A1 | 1/2008 | Stahl | |
| 2009/0235583 | A1 | 9/2009 | Colless et al. | |
| 2009/0266775 | A1 | 10/2009 | Vanderhoek et al. | |
| 2010/0096344 | A1 | 4/2010 | Vanderhoek et al. | |
| 2010/0175319 | A1 | 7/2010 | Meeks | |
| 2012/0011768 | A1 | 1/2012 | Martinez | |
| 2012/0317879 | A1 | 12/2012 | Morgan et al. | |
| 2013/0298463 | A1 | 11/2013 | Ke | |
| 2014/0026480 | A1 | 1/2014 | Lenhart, Jr. et al. | |
| 2014/0353271 | A1 * | 12/2014 | Kruse | A47F 5/01 211/188 |
| 2015/0001169 | A1 * | 1/2015 | Chen | A47B 87/0223 211/188 |
| 2015/0135588 | A1 | 5/2015 | Gergek | |
| 2016/0095430 | A1 * | 4/2016 | Moyer | A47B 47/0091 211/188 |
| 2017/0359964 | A1 | 12/2017 | Persico | |
| 2018/0125231 | A1 * | 5/2018 | Reyes | A47B 47/027 |
| 2019/0059242 | A1 | 2/2019 | Bogner et al. | |
| 2019/0124866 | A1 | 5/2019 | Maxwell | |
| 2021/0137264 | A1 * | 5/2021 | French | A47F 7/00 |
| 2022/0098881 | A1 * | 3/2022 | Siples | B65G 1/02 |
| 2022/0133034 | A1 * | 5/2022 | Moyer | A47B 87/0284 312/108 |
| 2023/0044061 | A1 * | 2/2023 | Yoon | A47B 96/1441 |
| 2023/0061415 | A1 * | 3/2023 | French | B65G 1/04 |
| 2024/0108129 | A1 * | 4/2024 | French | E06C 7/182 |
| 2024/0315178 | A1 * | 9/2024 | French | A01G 9/143 |

FOREIGN PATENT DOCUMENTS

| | | |
|---|---|---|
| WO | 2016014843 | 1/2016 |
| WO | 2019003201 | 1/2019 |

* cited by examiner

RACK SYSTEMS

CROSS REFERENCE TO RELATED APPLICATION

The present application claims the benefit of U.S. provisional application Ser. No. 63/383,414, filed Nov. 11, 2022, which is hereby incorporated herein by reference in its entirety.

FIELD

The present invention relates to storage racks for use in warehouses, work spaces, indoor grow facilities, and the like.

BACKGROUND

Storage rack systems are used in a wide variety of applications to increase storage density, or when storage space available in a given area is limited. Such systems are typically found in libraries, warehouses, indoor farming facilities, hospitals, or other businesses that need to stack large amount of inventory or various other items like products, files, plants, and books that need to be stored on shelving units and yet easily accessed periodically. In particularly limited spaces, these rack systems are known to extend high above the ground and well out of reach by personnel standing on the ground.

SUMMARY

The present invention provides a storage rack system incorporating various features allow for simplified fabrication, transportation, and set-up. For example, the rack system may be used for traditional warehouse storage or for supporting plants in an indoor growing facility or greenhouse.

In one form of the present invention, a storage rack post system includes upper and lower upright posts, a splice base, a splice plate, and fasteners for securing the splice plate to the splice base. The upper and lower upright posts are designed to be stacked end-to-end, and they are both generally C-shaped in cross-section, including a base leg and a pair of side legs. The side legs cooperate to define a longitudinal slot between them. The splice base has first and second legs angled relative to one another. The first leg of the splice base has a set of spaced-apart openings. The splice base is sized and shaped for longitudinal insertion into respective ends of the upright posts, with the first leg of the splice base aligned with the longitudinal slots of the upright posts. The splice plate has its own set of spaced-apart openings that align with the spaced-apart openings of the splice base. The fasteners are insertable through respective openings of the splice base and the splice plate. The lower upright post is securable to the upper upright post by inserting an upper end of the splice base into the upper upright post, inserting a lower end of the splice base into the lower upright post, arranging the upright posts adjacent one another in end-to-end alignment, and securing the splice plate to the splice base with the fasteners so that at least one of the side legs of each upright post is gripped or clamped between the splice plate and the splice base.

In one aspect, the splice base has a third leg that is angled relative to the first leg and parallel to the second leg. The third leg is arranged on an opposite side of said first leg from the second leg so that the splice base is generally C-shaped.

In another aspect, four of the storage post rack systems are set in a rectangular arrangement, with a lower support coupled to the lower upright posts of the four storage post rack systems and an upper support coupled to the upper upright posts of the four storage post rack systems.

In another form of the present invention, a structural support beam for a grow rack system includes an upright front wall, a splash guard panel, a sloped bottom panel, an upright rear wall, and a pair of upright end walls. The splash guard extends rearwardly from an upper end of the front wall, the sloped bottom panel extends rearwardly from a lower end of the front wall and defines a drain opening at a lower end. The upright rear wall extends upwardly from a rear end of the bottom panel, and the rear wall extends upwardly a shorter distance from the bottom panel than does the front wall. A pair of upright end walls couples respective opposite ends of the front and rear walls to each other and to respective opposite ends of the sloped bottom panel. The structural support beam is designed to support a plant support tray resting on an upper edge of the upright rear wall, and is further designed to channel water runoff from the plant support tray to the drain opening.

In one aspect, each of the end walls have a lateral extension portion designed to extend at least partially in front of a respective upright post, and a mounting portion extending rearwardly from the lateral extension portion in order to engage the respective upright post.

According to yet another form of the present invention, a storage rack includes a pair of hollow upright posts, a cross beam, and a stud at each end of the cross beam. The upright posts are spaced apart horizontally, and each defines a set of keyhole openings in vertically spaced arrangement. The keyhole openings have larger upper regions and smaller lower regions that are open to the upper portions. The studs are configured to releasably couple to one of the upright posts at respective keyhole openings. Each stud includes a head portion, a shank, and a tail portion. The head portion is disposed along a front surface of the cross beam, the shank extends rearwardly from the head portion and through the cross beam, and has a diameter that is less than or equal to the width of the lower portions of the keyhole openings. The tail portion has a larger diameter that the diameter of the shank, and also larger than the width of the lower portions of the keyhole openings, but less than the width of the upper portions of the keyhole openings. The tail portion is spaced apart from a rear surface of the cross beam by a distance equal to or greater than a wall thickness of the upright posts at the keyhole openings. This leaves the shank exposed between the tail portion and the rear surface of the cross beam. The cross beam is securable to the upright posts by insertion of the tail portions of the studs into the upper portions of the respective keyhole openings of the upright posts, and lowering the shanks into the lower portions of the keyhole openings. Optionally, the studs are rivets whose head portions are formed by striking the ends of the shanks that are opposite the tail portions, in order to expand the shank ends.

The present invention provides a storage rack system incorporating various features allow for simplified and convenient set-up, take-down, transportation or relocation, as well as lower part counts, simplified fabrication, and the ability to make small dimensional adjustments if desired. The storage rack system may include multi-function components, such as a structural support beam that also serves as a drainage trough for runoff liquids. The storage rack system can be used to form multi-tier storage or support levels in order to make efficient use of floor space by utilizing more of the vertical space above the footprint of a given rack system.

These and other objects, advantages, purposes and features of the present invention will become apparent upon review of the following specification in conjunction with the drawings.

DETAILED DESCRIPTION OF THE PREFERRED EMBODIMENTS

Figure 1:
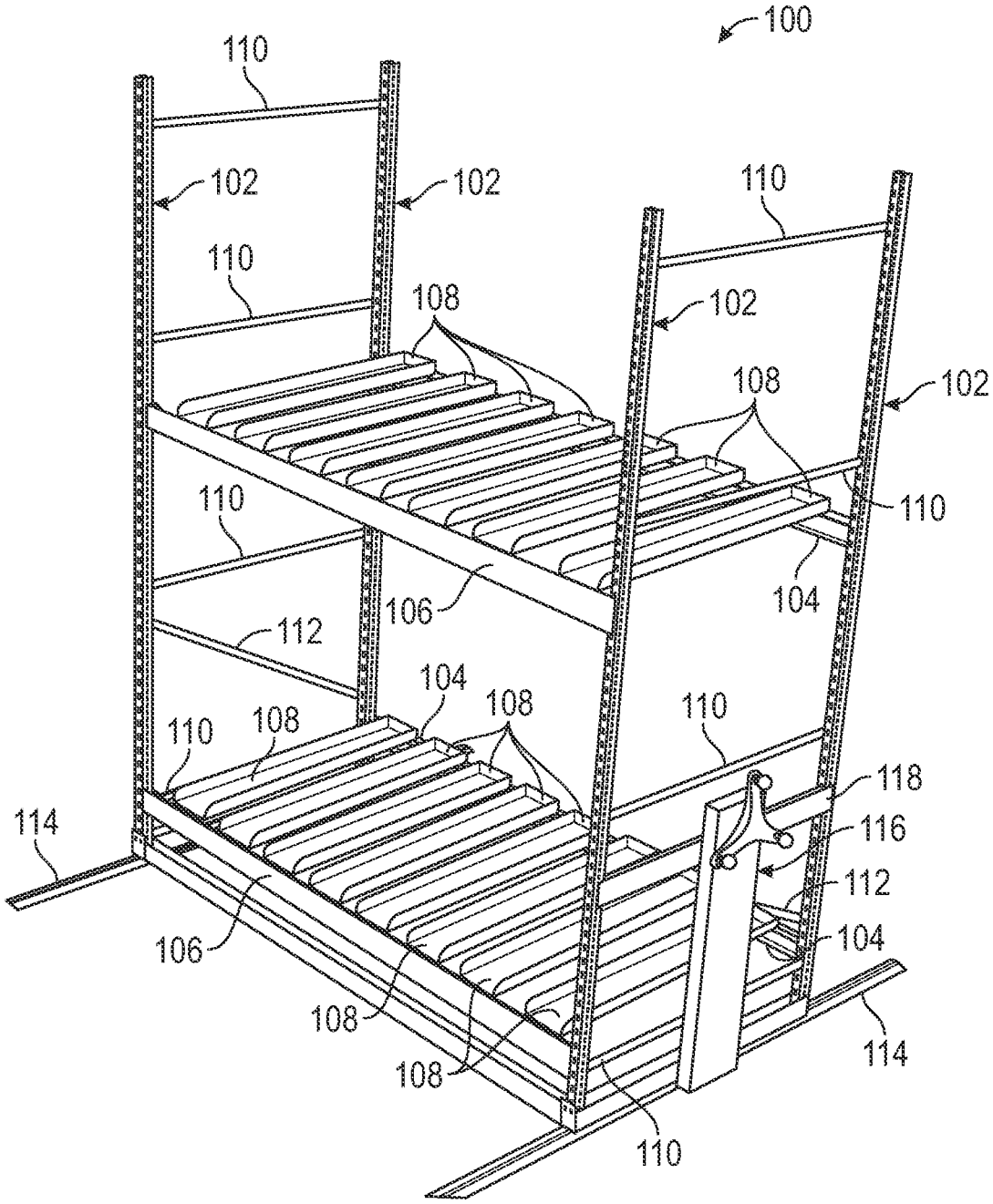
FIG. 1 is a perspective view of a grow rack system in accordance with an embodiment of the present invention.
Figure 2:
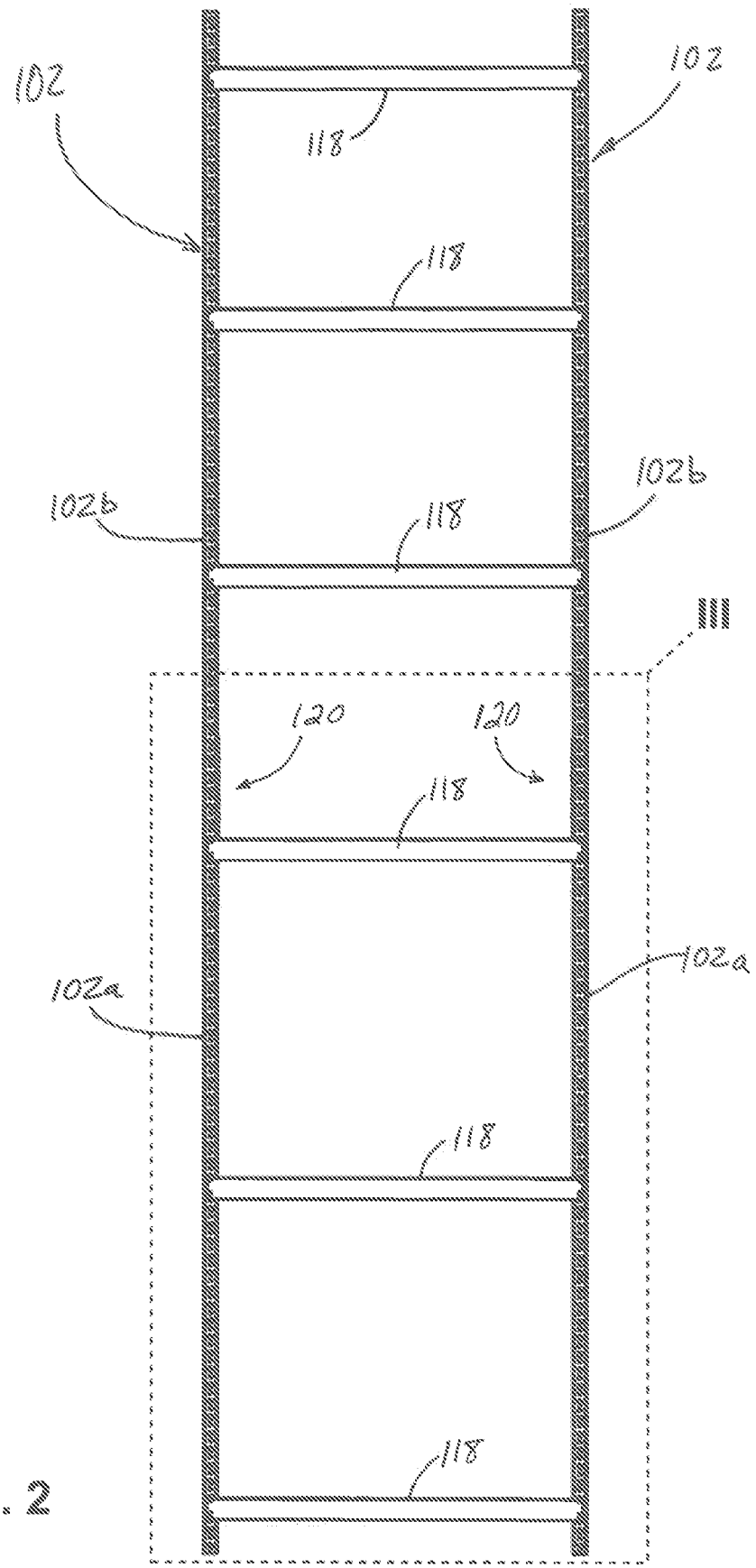
FIG. 2 is an end elevation view of a rack assembly including two pair of uprights joined by cross members and stacked vertically using splice joints in accordance with an embodiment of the present invention.
Figure 3:
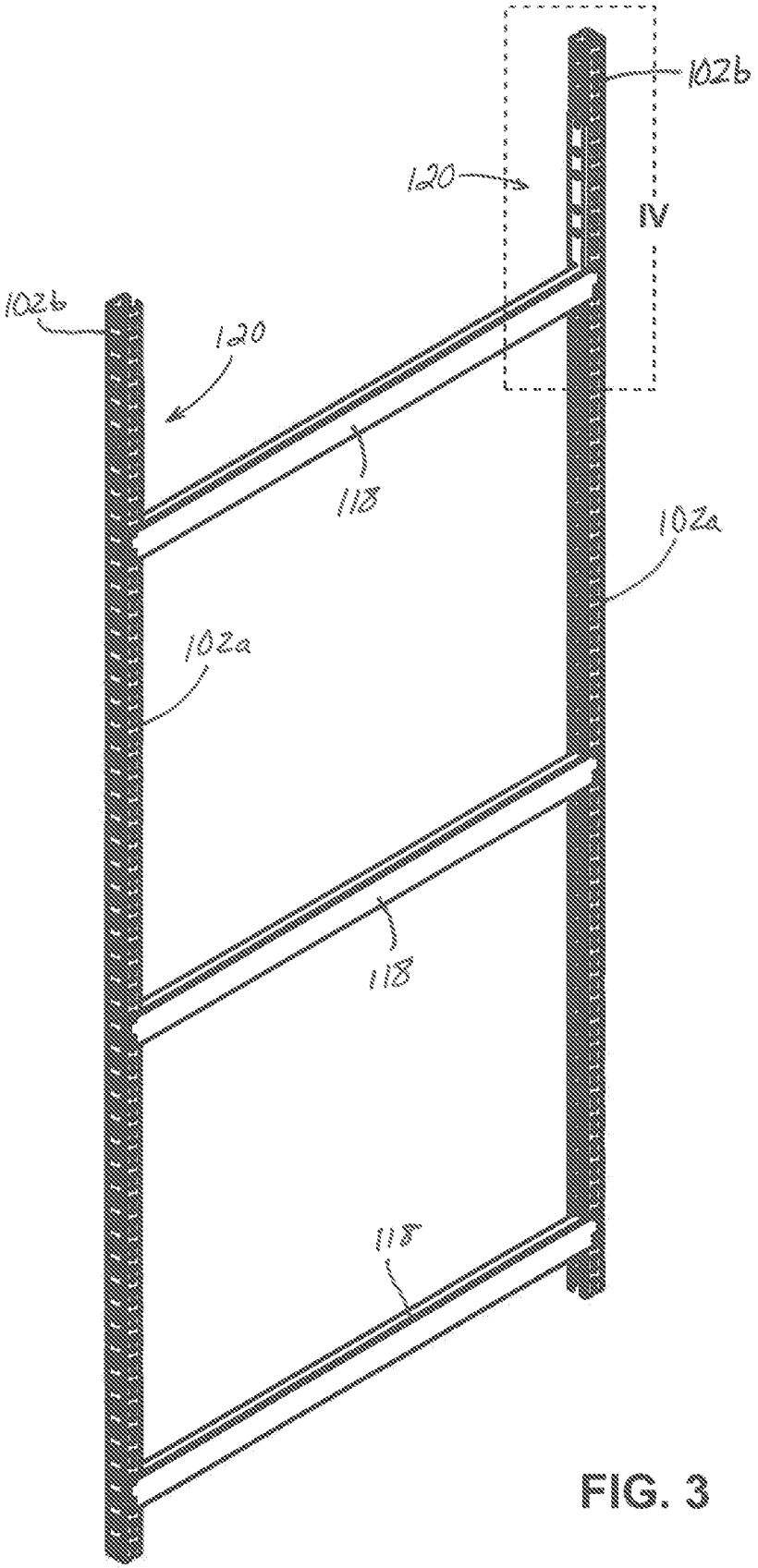
FIG. 3 is an enlarged perspective view of the region designated III in FIG. 2.

Referring now to the drawings and the illustrative embodiments depicted therein, a storage or grow rack system 100 includes four upright post assemblies 102, rear support beams 104 and front drainage support beams 106 extending between respective pairs of upright post assemblies 102, and a plurality of plant support trays 108 supported between respective sets of support beams 104, 106 (FIG. 1). Each end pair of post assemblies 102 may be joined by a plurality of horizontal cross members or stabilizers 110 and one or more diagonal cross members or stabilizers 112. In the illustrated embodiment of FIG. 1, storage or grow rack system 100 is a movable unit mounted on a pair of floor rails 114, with a manual drive system 116 supported in part by another horizontal beam 118 that extends between an end pair of post assemblies 102. Storage or grow rack system 100 includes numerous features that make it particularly flexible for use in indoor warehousing or grow facilities including "vertical farming" operations with multiple tiers or levels of grow areas that require ladders, stairs, or powered lifts for access to upper regions. As will be described in more detail below, upright post assemblies 102 are assembled from two or more post sections that are joined end-to-end to achieve a desired overall height. Front drainage support beams 106 provide both structural support for front ends of plant support trays 108 and drainage for water, nutrients, and small particulates that flow off of trays 108. Horizontal beam 118 utilizes a set of specially-formed rivets for releasable attachment to an end pair of post assemblies 102. The various features allow for simpler and more convenient set-up, take-down, transportation or relocation of storage or grow rack system 100, including lower part counts and simplified fabrication that may allow for reduced material and labor costs.

Figure 4:
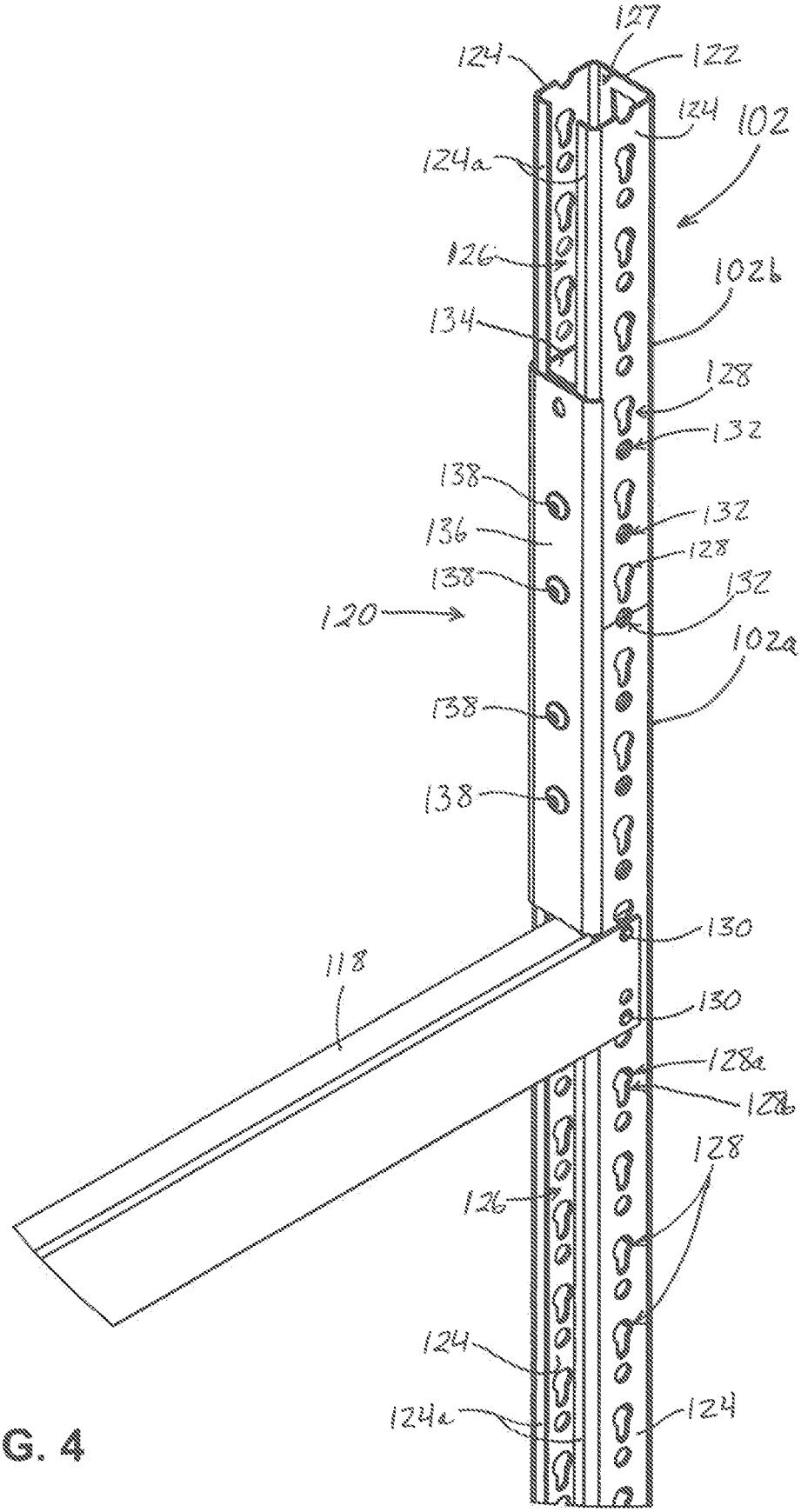
FIG. 4 is an enlarged view of the area designated IV in FIG. 3.
Figure 5:
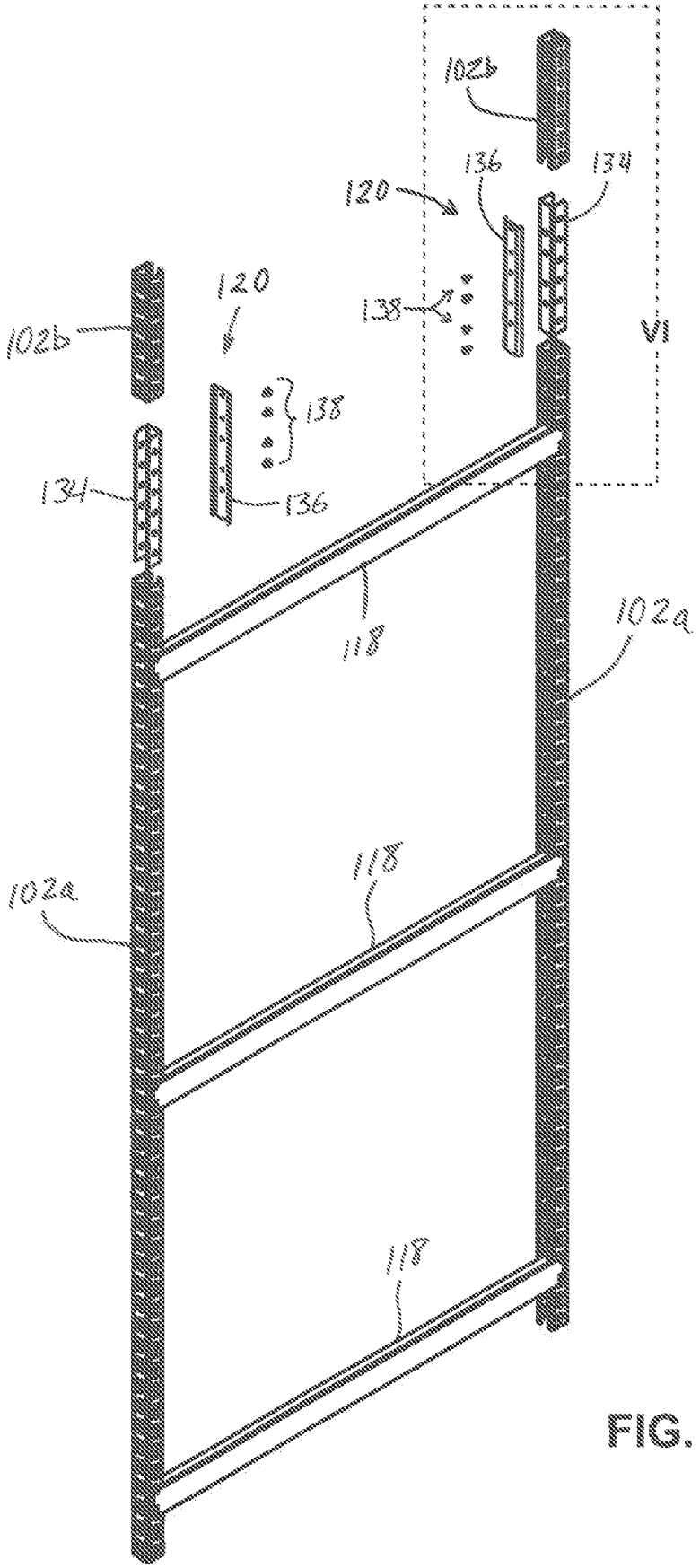
FIG. 5 is an exploded perspective view of the lower region of FIG. 3.
Figure 6:
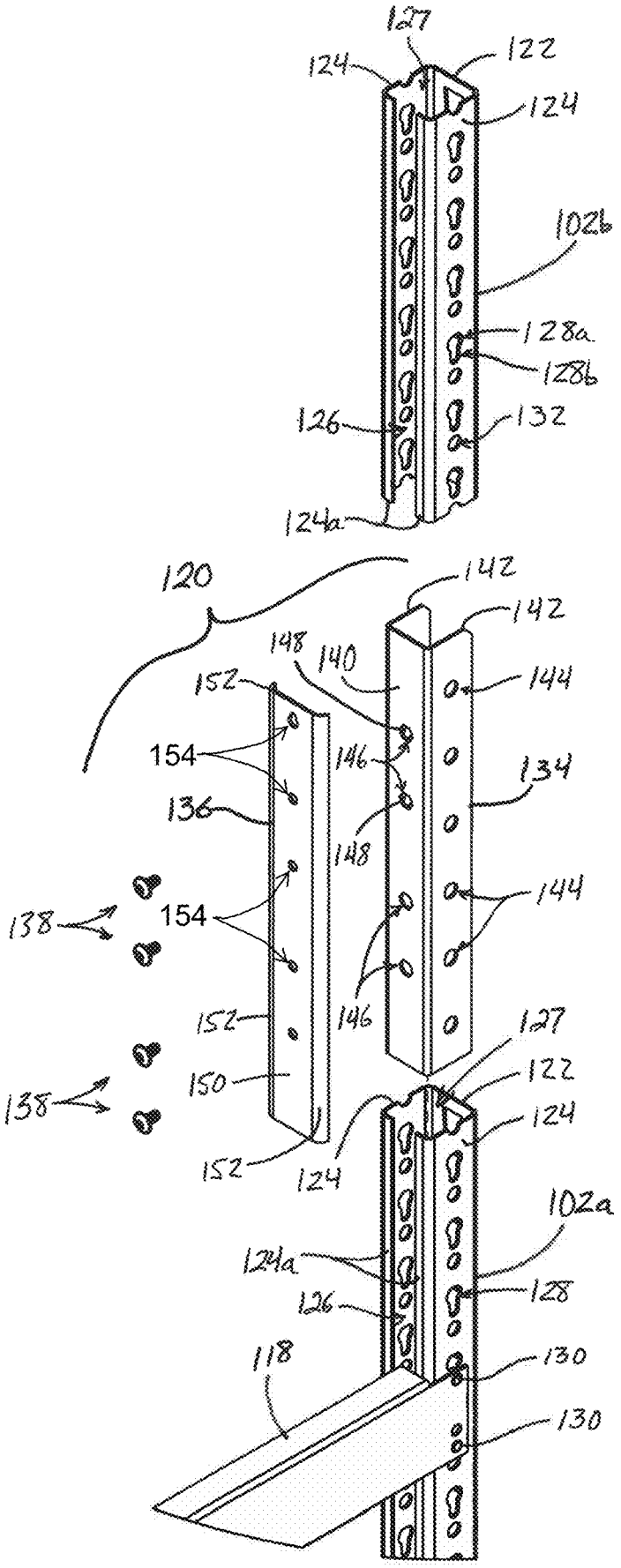
FIG. 6 is an enlarged view of the area designated VI in FIG. 5.
Figure 7:
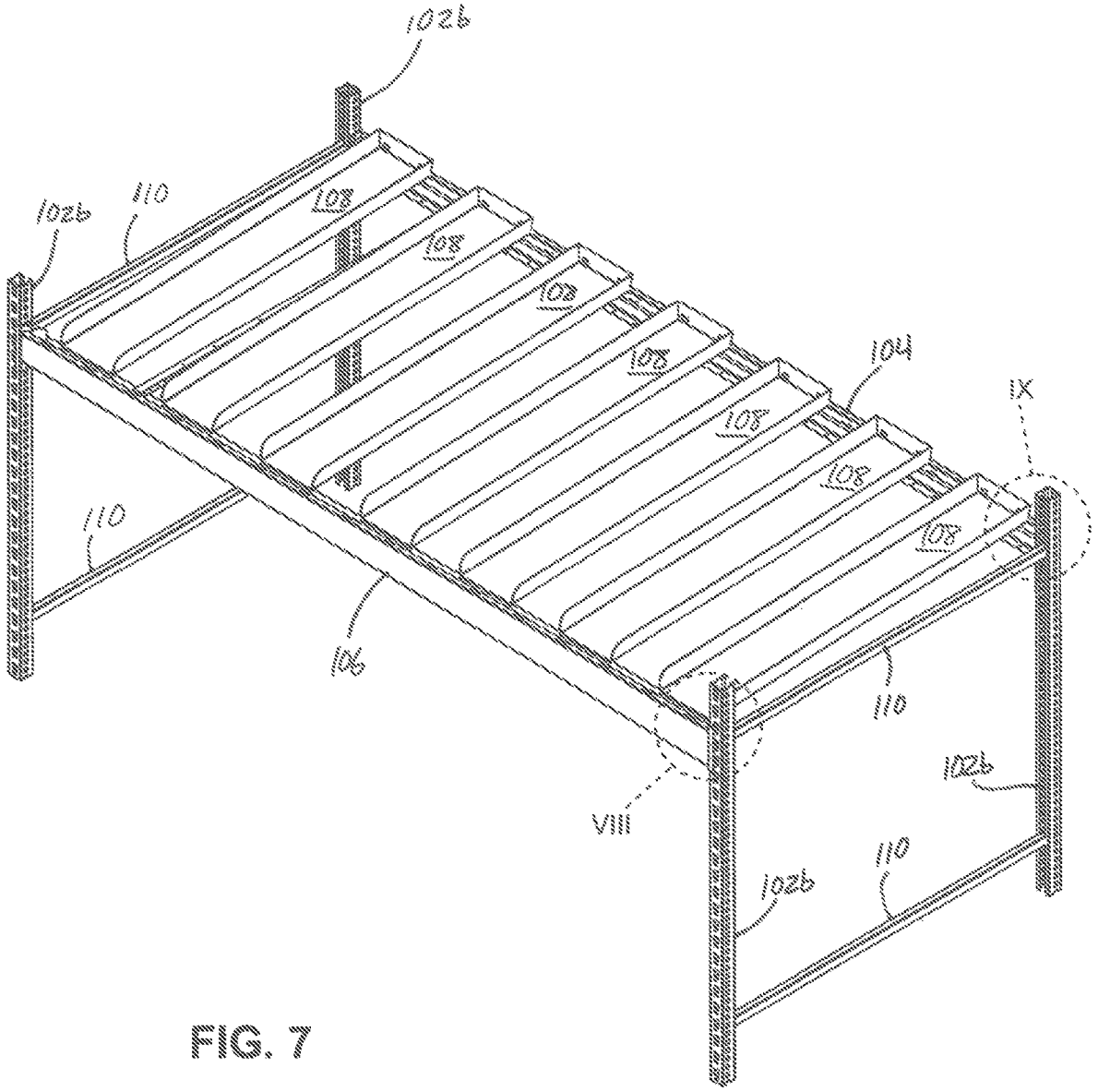
FIG. 7 is a perspective view of a portion of a grow rack system of FIG. 1.

Each post assembly 102 is assembled from at least one lower upright post 102*a* and at least one upper upright post 102*b*, such as shown in FIGS. 2-6. Upright posts 102*a*, 102*b* are typically identical to one another in cross section and overall configuration, although their lengths may be different according to the desired total height of the post assembly 102 that they form. A splice joint assembly 120, best shown in FIG. 6, is used to secure each lower post 102*a* to a corresponding upper post 102*b* in a manner that maintains the posts 102*a*, 102*b* with their longitudinal axes substantially aligned and the posts' adjacent ends in abutting contact or in close proximity to one another. In the illustrated embodiment, each post 102*a*, 102*b* is generally C-shaped and is formed by a base leg 122 and a pair of side legs 124. The side legs 124 include inwardly-directed flanges 124*a* that are spaced apart from one another to define a longitudinal slot 126 that is open to a hollow interior 127 of each post 102*a*, 102*b*.

The side legs 124 define a series of evenly-spaced keyhole openings 128 with larger-diameter upper regions 128*a* and smaller-diameter lower regions 128*b* for releasably receiving T-posts 130 of horizontal beams 118, for example. In the illustrated embodiment, keyhole openings 128 alternate with circular openings 132 that may serve as additional attachment points or cutting guides. As best shown in FIGS. 4 and 6, upper post 102*b* and lower post 102*a* have both been cut in a manner that bisects circular openings 132 at their lower and upper ends, respectively. In this manner, when the lower end of upper post 102*b* is abutted or nearly abutted against the upper end of lower post 102*a* as shown in FIGS. 4 and 6, the spacing of keyhole openings 128 remains consistent through the transition from lower post 102*a* to upper post 102*b*.

Splice joint assembly 120 includes an elongate splice base 134, an elongate splice plate 136, and a plurality of fasteners 138 for securing the splice plate 136 to the splice base 134, as shown in FIGS. 4-6. Splice base 134 has a bight or base leg 140 and a pair of side legs 142 extending perpendicular to base leg 140 and parallel to one another. Splice base 134 is sized and shaped to fit into the hollow interior 127 of each post 102*a*, 102*b*, with base leg 140 backing up to the side legs' inwardly-directed flanges 124*a* and longitudinal slot 126, and with side legs 142 positioned alongside respective side legs 124 of the upright posts 102*a*, 102*b*. In the illustrated embodiment, splice base 134 is generally U-shaped, which has been found to provide a desirable level of rigidity and strength to the splice connection of upright posts 102*a*, 102*b*. However, it will be appreciated that a hollow square tube, an L-shape (with single base leg and single side leg), or even a planar plate with or without angled or curved side edges (similar to the shape of splice plate 136) may also be used.

Referring to FIG. 6, each side leg 142 of splice base 134 defines a plurality of spaced-apart circular openings 144 that can be aligned with respective circular openings 132 of the posts' side legs 124. In addition, base leg 140 of splice base 134 defines a plurality of spaced-apart hexagonal openings 146 that may be fitted with threaded weld-nuts 148 for receiving threaded shafts of respective fasteners 138. Alternatively, base leg 140 may be formed with threaded bores, or non-threaded bores to be engaged by self-tapping fasteners. With reference to FIG. 4, keyhole openings 128 of upright posts 102*a*, 102*b* are backed by solid portions of the splice base's side legs 142 so that keyhole openings 128 are unusable in the regions of splice joint assemblies 120. However, it is envisioned that keyhole openings 128 may optionally remain usable in the regions of splice joint assemblies, such as by spacing the splice base's side legs 142 inwardly from the upright posts' side legs 124, or by forming additional holes in the splice base's side legs 142, between the circular openings 144, so that keyhole openings 128 may be used in the regions of splice joint assemblies.

Splice plate 136 is rectangular in overall shape, including a generally planar base plate 150 and a pair of curved side flanges 152 whose curvature generally matches the exterior curvature of upright posts 102*a*, 102*b* through the transition from side legs 124 to their respective inwardly-directed flanges 124*a*. Base plate 150 defines a plurality of spaced-apart openings 154 that align with hexagonal openings 146 of splice base 134 so that fasteners 138 may be inserted through openings 154 in splice plate 136 and threadedly engaged with splice base 134 at openings 146.

Each upright post assembly 102 may be assembled by first loosely attaching splice plate 136 to splice base 134 and inserting fasteners 138 through openings 154 and partially threading them into weld-nuts 148 at openings 146 in splice base 134, leaving a gap between splice plate 136 and splice base 134, the gap being wider than the material thickness of inwardly-directed flanges 124*a* of each upright post 102*a*, 102*b*. This allows the upper portion of splice base 134 to be slid into the lower portion of upper post 102*b*, and the lower portion of splice base 134 to be slid into the upper portion of lower post 102*a*, with splice plate 136 remaining outside of the posts 102*a*, 102*b*, and fasteners 138 extending through longitudinal slots 126 of the posts 102*a*, 102*b* as the posts are brought together in end-to-end arrangement as shown in FIG. 4. An assembler may thus use splice plate 136 as a gripping surface to slide splice joint assembly 120 into a desired position relative to the vertically-stacked posts 102*a*, 102*b*, such as with one half of the splice base 134 located in each post 102*a*, 102*b*, and with the openings 144 in each side leg 142 of splice base 134 aligned with corresponding openings 132 in each side leg 124 of posts 102*a*, 102*b*.

Fasteners 136 are then tightened so that splice base 134 and splice plate 136 are drawn tightly together to clamp or grip against inwardly-directed flanges 124*a* of each post 102*a*, 102*b*. Because of the gap that will typically remain between splice base 134 and splice plate 136 at longitudinal slot 126, fasteners 136 may be tightened so as to cause splice base 134 and splice plate 136 to elastically flex or bow towards one another, which helps to ensure that a high level of clamping force is maintained even if fasteners 136 were to be slightly loosened. This gripping or clamping arrangement ensures that upper post 102*b* is held in alignment with lower post 102*a* so that vertical and lateral loads applied to upper post 102*b* are directed to the corresponding lower post 102*a* by the splice joint assembly 120, and optionally by direct contact between the respective abutting ends of posts 102*a*, 102*b*. Optionally, additional fasteners (not shown) may be inserted through openings 132 of each post 102*a*, 102*b* at splice joint assembly 120 and threadedly engaged with splice base 134 at openings 144, to provide further strength and stabilization at splice joint assembly 120.

It will be appreciated that other assembly methods are possible, such as first inserting the upper half of splice base 134 into the lower end of upper post 120*b*, and then lowering upper post 120*b* and splice base 134 together so that the lower half of splice base 134 is inserted into the upper end of lower post 120*a* until the ends of posts 120*a*, 120*b* are abutting or nearly abutting one another. Final alignment adjustments of splice base 134 may be performed by inserting a tool through longitudinal slot 126 and raising or lowering splice base 134 in the posts' hollow interiors 127 until splice base 134 is properly aligned with the posts 120*a*, 120*b*. Splice plate 136 may then be attached with fasteners 138, which can be immediately tightened to provide gripping or clamping force as described above. Optionally, final adjustments of splice base 134 may be performed after splice plate 136 is attached, but before fasteners 138 are fully tightened.

Splice joint assemblies 120 allow for the construction of upright post assemblies 102 for use in assembling storage or grow rack system 100, with multiple tiers and extended heights made possible without the use of very long one-piece upright posts that are difficult to transport and difficult to move within storage or plant-growing facilities. Splice joint assemblies 120 are made up of few parts and are relatively easy to properly align and assemble, as well as to disassemble and reassemble as desired. Splice joint assemblies 120 may also be used to lengthen upright post assemblies 102 by allowing for some spacing between stacked upright posts, such as if one or two inches of spacing between lower post 102*b* and upper post 102*a* would provide helpful additional clearance for structures or products or plants supported on a platforms defined by or supported between rear support beam 104, front drainage support beam 106, horizontal cross members 110, and plant support trays 108.

Figure 8:
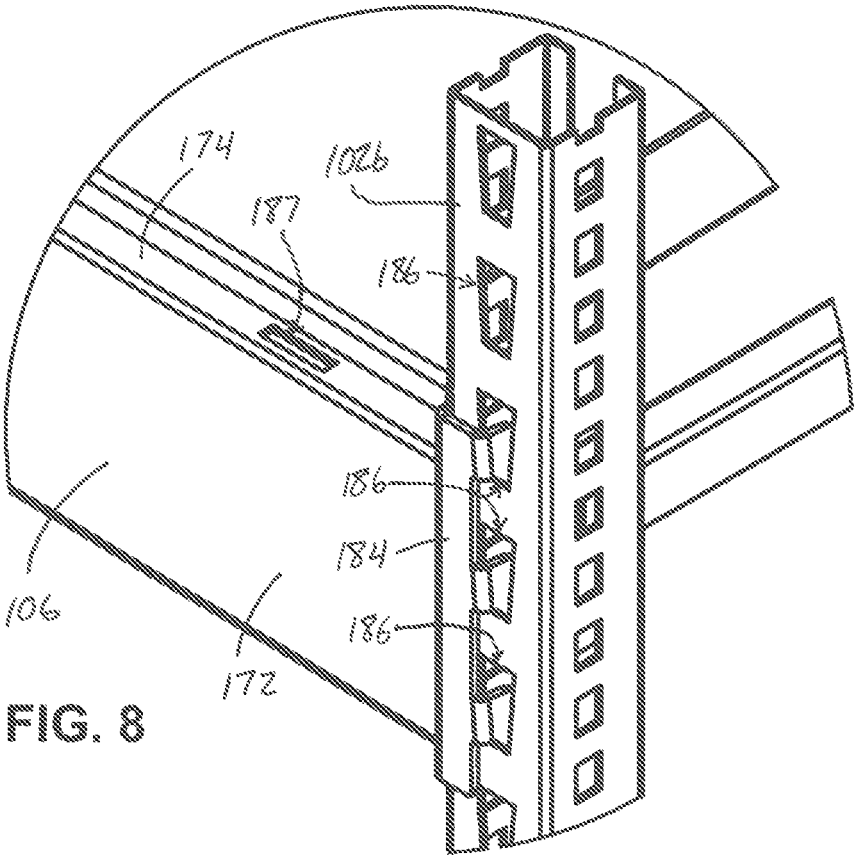
FIG. 8 is an enlarged view of the area designated VIII in FIG. 7.
Figure 9:
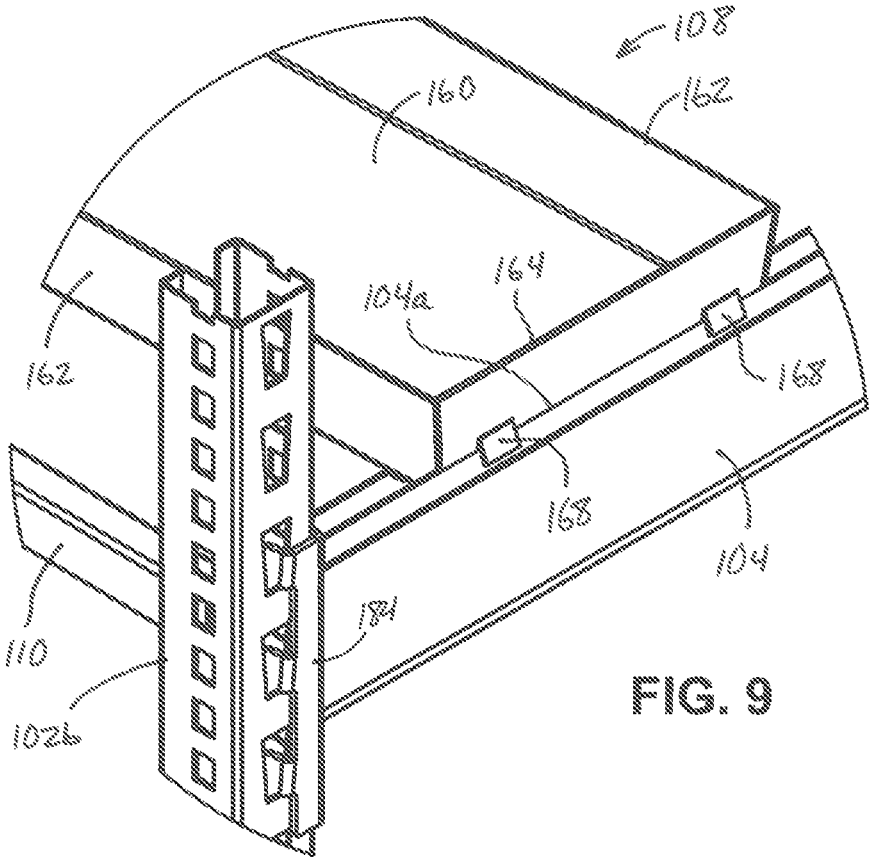
FIG. 9 is an enlarged rear perspective view of the area designated IX in FIG. 7.
Figure 10:
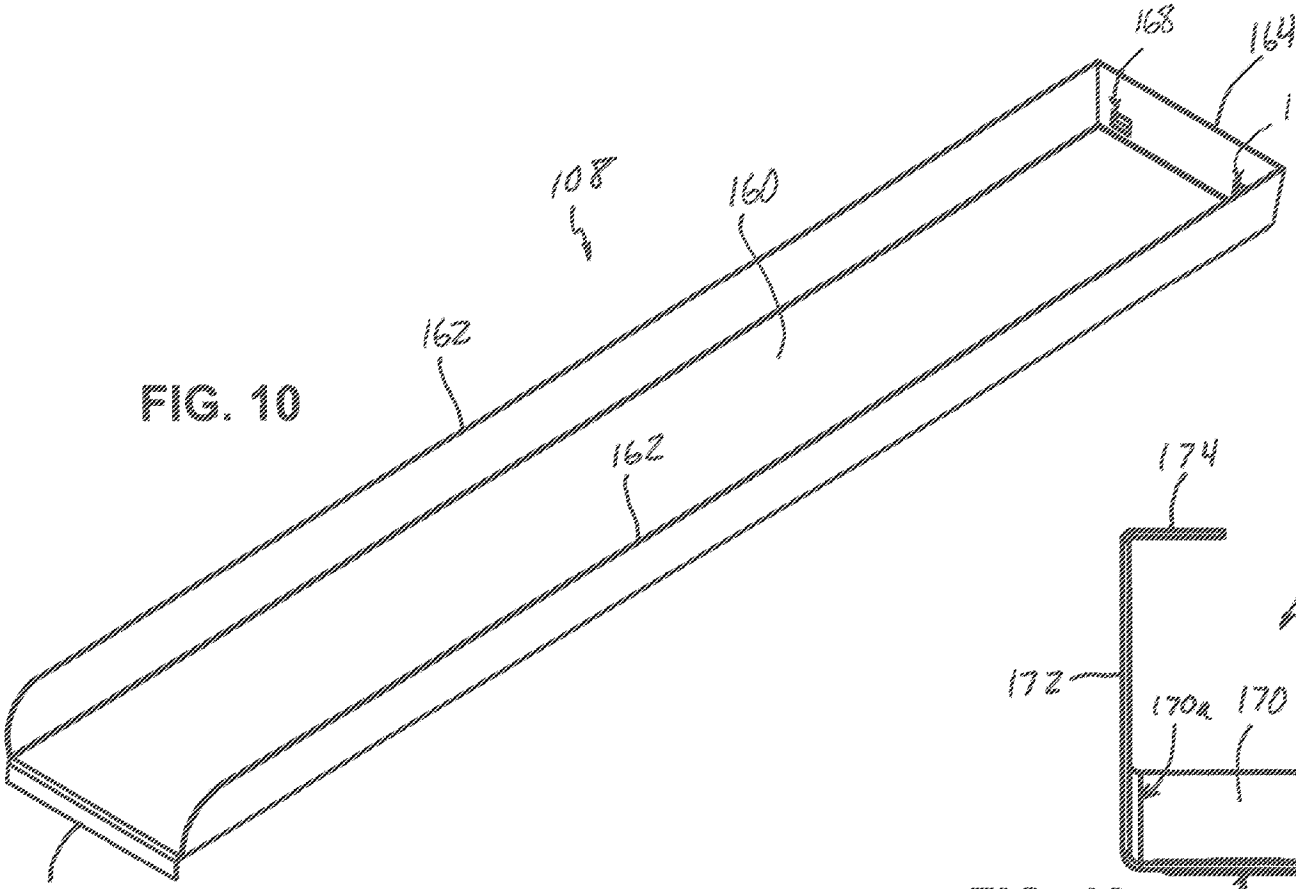
FIG. 10 is a perspective view of a plant support tray of the grow rack system of FIG. 7.

Referring now to FIGS. 7-16, components of storage or grow rack system 100 are shown in greater detail, including rear support beam 104, front drainage support beam 106, and plant support trays 108. Rear support beams 104 and front drainage support beams 106 are designed for supporting a plurality of plant support trays 108 as shown, but may also be used to support single large plant support trays or other forms of shelving, including for warehousing application for various goods. Plant support trays 108 include a rectangular base panel 160 with a pair of upright sidewalls 162 and a rear wall 164 extending upwardly, and a forward spillover lip 166 (FIGS. 10 and 16) that hooks over an upper edge of drainage beam 106 and allows liquids to flow off base panel 160 and into drainage beam 106, as described below. Rear wall 164 includes a pair of rearward-extending tabs 168 (FIGS. 9 and 10) that, in the illustrated embodiment, are punched from rear wall 164, which may be made of sheet metal. Tabs 168 hook over an upper lip 104*a* of rear support beam 104 as shown in FIG. 9, so that the rear component of each tray's weight is supported at tabs 168.

Figure 12:
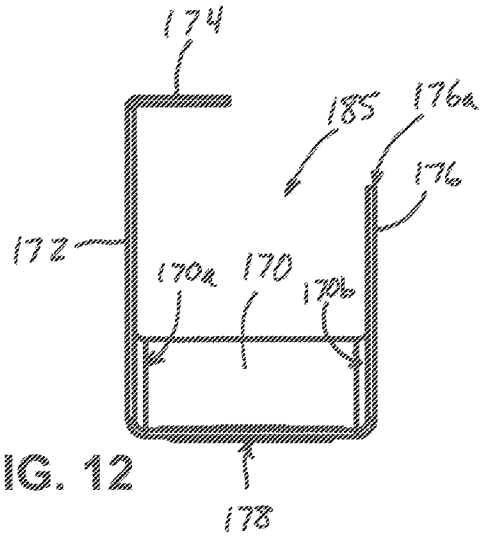
FIG. 12 is an end section view of the drainage beam of FIG. 11.
Figure 11:
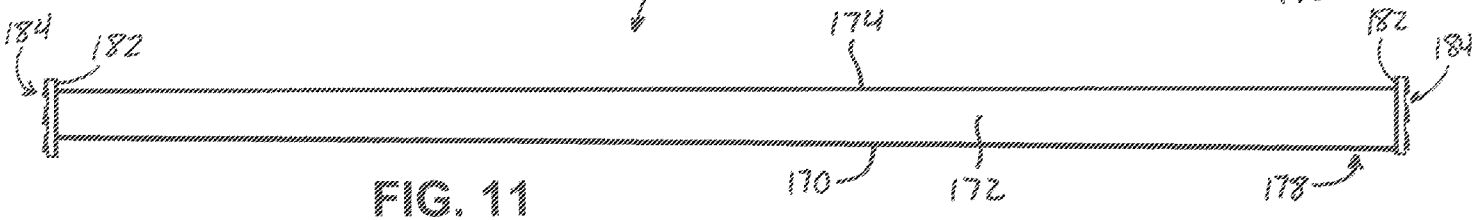
FIG. 11 is a side elevation view of a drainage beam of the grow rack system of FIG. 7.
Figure 13:
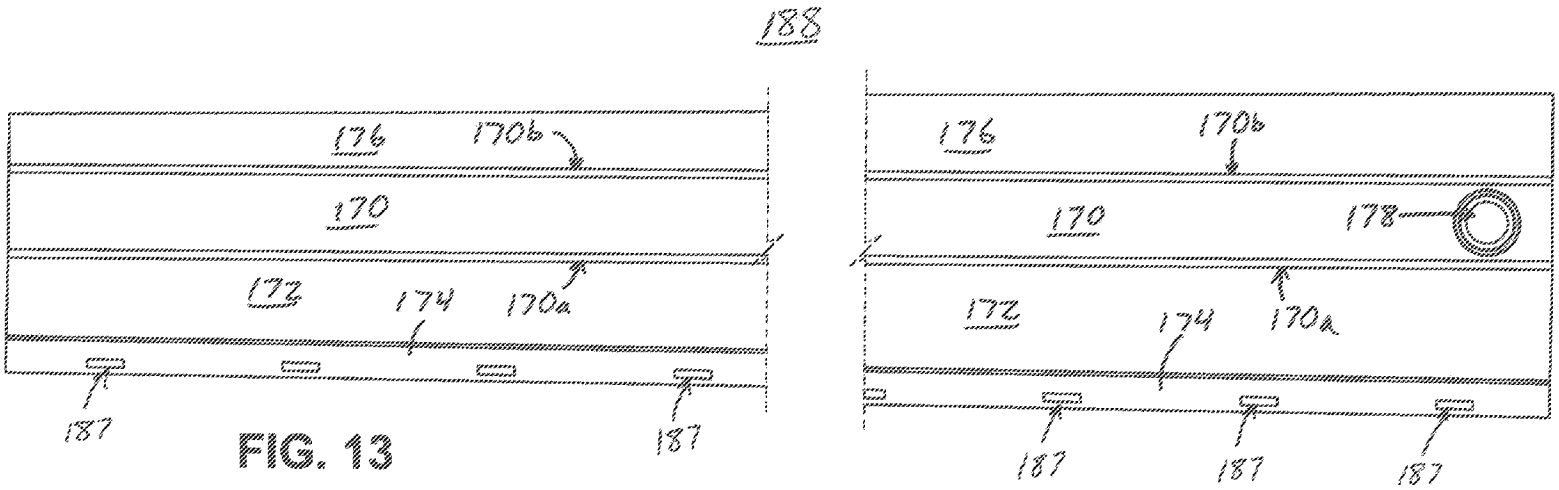
FIG. 13 is a top plan view of a unitary metal sheet for forming portions of the drainage beam of FIG. 11, excluding end walls and with a middle region omitted between break lines.
Figure 16:
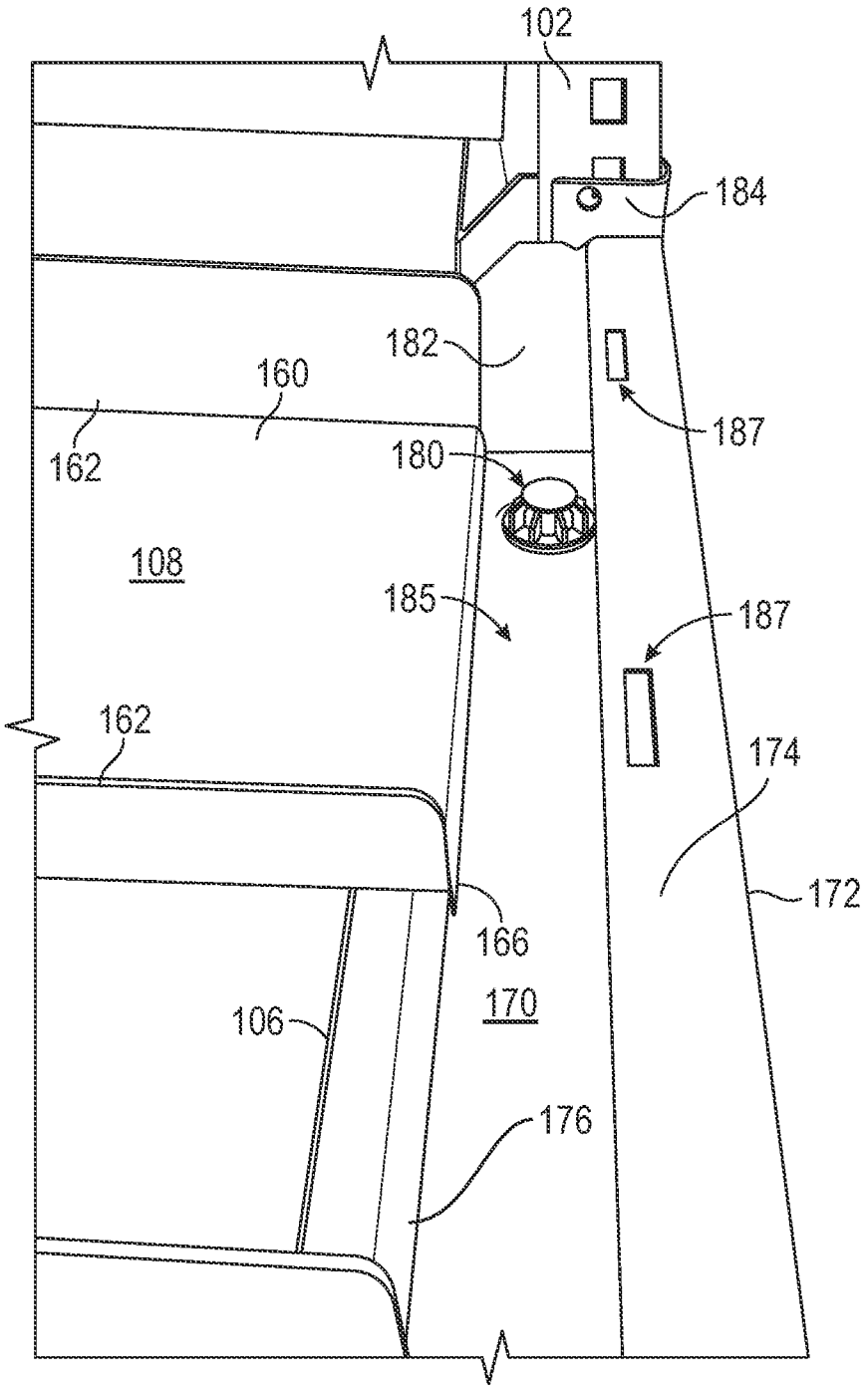
FIG. 16 is a top perspective view of a tray and front drainage beam of the grow rack system.

Front drainage support beam 106 includes a sloped bottom panel 170, an upright front wall 172 extending upwardly from a forward edge of bottom panel 170, a splash guard panel 174 that extends rearwardly from an upper end of front wall 172, and an upright rear wall 176 that extends upwardly from a rear edge of bottom panel 170 (FIGS. 11 and 12). Bottom panel 170 defines a drain opening 178 at its lower end, which may be fitted with a combination strainer and hose fitting 180 as shown in FIG. 16. A pair of upright end walls 182 close off the opposite ends of drainage beam 106 (FIGS. 11 and 16), and include attachment features in the form of lateral extension portions 184 extending laterally outwardly and rearwardly to engage respective upright posts 102*b* at spaced-apart openings 186 formed therein (FIG. 8). An upper edge 176*a* of rear wall 176 supports the loads of the forward ends of plant support trays 108, with forward spillover lip 166 hanging over the upper edge 176*a* so that liquids flowing off of base panel 160 will spill into a drainage channel 185 defined by drainage beam 106. In the illustrated embodiment, upper edge 176*a* sits level with splash guard 174, and does not slope with bottom panel 170. To increase the structural strength of drainage beam 106 in flexure due to loads from plant support trays 108, the heights of both rear wall 176 and front wall 172 exceed the width of bottom panel 170. As best shown in FIGS. 8 and 13, a series of rectangular openings 187 are formed in splash guard 174, which may facilitate hanging tools, equipment, or fluid lines from drainage beam 106.

Figure 14:
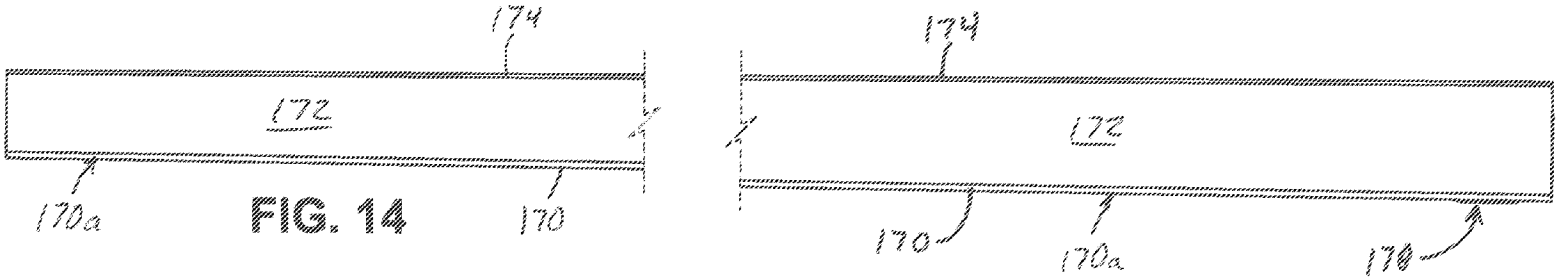
FIG. 14 is a front elevation view of the unitary metal sheet of FIG. 12, shown in a formed configuration.
Figure 15:
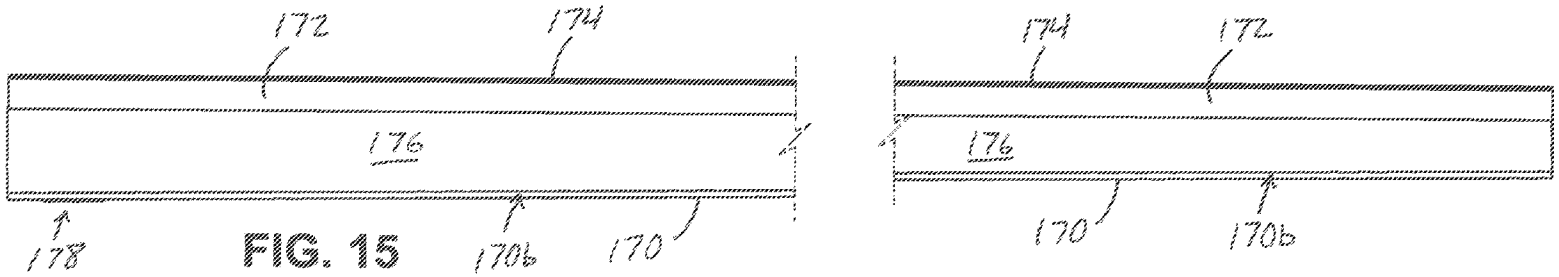
FIG. 15 is a rear elevation view of the formed unitary metal sheet of FIG. 14.

Bottom panel 170, front wall 172, splash guard 174, and rear wall 176 may be unitarily formed by a single metal sheet 188 as shown in FIG. 13. Metal sheet 188 has a trapezoidal shape because the portions forming front and rear walls 172, 176 are shorter at one end and taller at the other end (where drain opening 178 is formed) to provide the gentle slope of bottom panel 170 once the appropriate bends are formed in metal sheet 188. Optionally, a resinous plastic may be used instead of metal, and vacuum-formed or otherwise molded or formed to the final desired shape. Thus, drainage beam 106 provides both a structural support for plant trays 108, and a trough or channel 185 for capturing liquid runoff from plant trays 108 and channeling it to drain opening 178. Rear support beam 104 may be Z-shaped such as shown in FIGS. 11 and 14 of commonly-owned U.S. Pat. No. 11,116,148, which is hereby incorporated herein by reference in its entirety. Optionally, rear support beam 104 may be similar or substantially identical to front drainage beam 106, with the splash guard 174 of drainage beam 106 corresponding to upper lip 104*a* of rear support beam 104. Rear support beam 104 may be set slightly higher than front drainage beam 106 to facilitate drainage of plat support trays 108 into drainage channel 185.

Plant support trays 108 and drainage beam 106 are preferably made from strong and corrosion-resistant materials for use in humid spaces and with continuous liquid water contact. They may advantageously have smooth surfaces to facilitate cleaning, and may be formed from sheet steel that is coated in an anti-microbial/anti-fungal powder coat finish to resist unwanted growth in wet environments.

Figure 17:
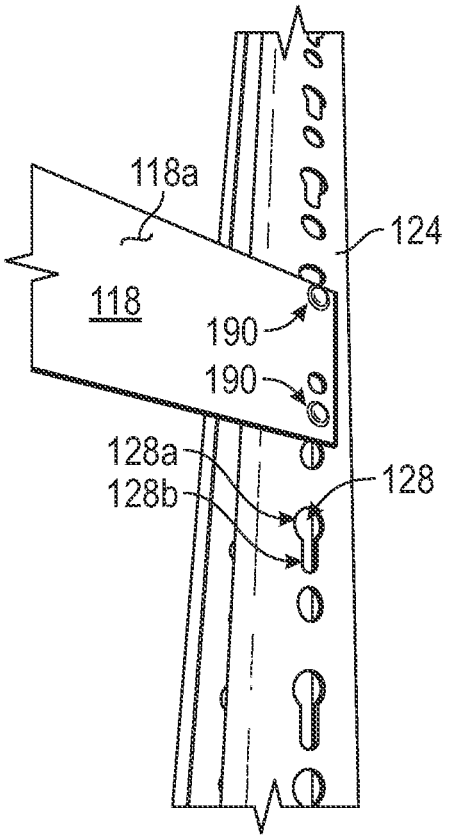
FIG. 17 is a perspective view of a cross beam with rivet-studs for coupling to an upright, in accordance with the present invention.
Figure 18:
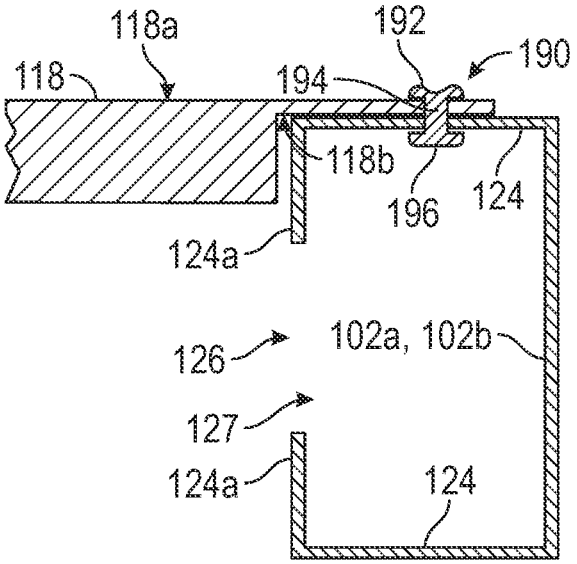
FIG. 18 is a top view of another cross beam with rivet-studs coupled to an upright.
Figure 19:
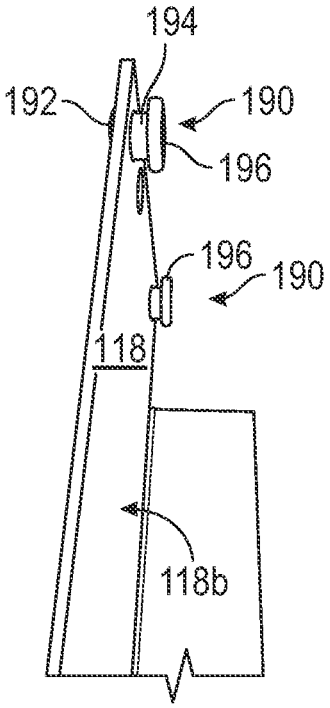
FIG. 19 is a bottom perspective view of the cross beam with rivet-studs of FIG. 17.

Referring to FIGS. 17-19, horizontal cross beams 118 may be releasably coupled to uprights 102 by studs or rivets 190 that engage keyhole openings 128 in the uprights' side legs 142. Each stud or rivet 190 includes a head portion 192 that is positioned along a front surface 118*a* of the cross beam 118, a shank 194 that extends rearwardly from the head portion 192 and through the cross beam 118, and a tail portion 196 that is spaced from a rear surface 118*b* of the cross beam 118. Shank 194 has a diameter that is less than or equal to the width of the lower portions 128*b* of the keyhole openings 128, while tail portion 196 has a diameter that is less than the width of the upper portions 128*a* of the keyhole openings, and greater than the width of the lower portions 128*b* of the keyhole openings 128.

As shown in FIGS. 18 and 19, the tail portion 196 is spaced apart from the rear surface 118*b* of the cross beam 118 by a distance equal to or greater than the wall thickness of the upright posts 102*a*, 102*b* so that the shank 194 is exposed between the tail portion 196 and the rear surface 118*b* of the cross beam 118. The spacing of tail portion 196 and exposure of shank 194 between tail portion 196 and rear surface 118*b* of the cross beam 118 can be accomplished using a spacer tool, for example. When used as solid rivets, the shanks 194 may initially be of continuous diameter extending away from the tail portions 196. The head ends of the shanks 194 are inserted through holes formed in the cross beam 118 so that the head ends project rearwardly beyond the rear surface 118*b* of the cross beam 118. A spacer tool, similar to an open-end wrench, may be placed around the shank 194 between the front surface 118*a* of the cross beam 118 and the tail portion 196. The head end of the shank 194 is then struck with a hammer, rivet gun, or other striking tool, while the tail portion 196 is supported by a bucking bar or similar tool. This causes the head end of the shank 194 to expand in diameter, thus forming head portion 192 along the rear surface 118*b* of the cross beam 118. The spacer tool is then removed from the shank 194, leaving the finished studs or rivets 190 as shown in FIGS. 17-19.

Once the studs or rivets 190 are installed, the cross beam 118 may be coupled to the upright posts 102*a*, 102*b* by insertion of the tail portions 196 of the studs or rivets 190 into the upper portions 128*a* of respective ones of the keyhole openings 128 of the upright posts. The shanks 194 are then lowered into the lower portions 128*b* of the keyhole openings 128 so that the tail portions 196 are captured by the lower portions 128*b* of the keyhole openings 128.

Therefore, the storage rack system has several features that facilitate fabrication, transportation, set-up, and disassembly, and can provide multi-tier storage or support levels. The system also facilitates height adjustments to platforms or other supports that are mounted to uprights of the rack system, which can be useful in plant growing facilities where height adjustments may be desired as plants grow from seedlings to fully mature or harvest-ready sizes. A structural support beam that can serve as a drainage trough for runoff liquids simplifies assembly and can also limit or eliminate the intrusion of structures into the spaces between adjacent rack systems.

Changes and modifications in the specifically described embodiments may be carried out without departing from the principles of the present invention, which is intended to be limited only by the scope of the appended claims, as interpreted according to the principles of patent law including the doctrine of equivalents.

The embodiments of the invention in which an exclusive property or privilege is claimed are defined as follows:

1. A storage rack post system comprising:

an upper upright post and a lower upright post configured to be stacked end-to-end, wherein said upright posts are generally C-shaped including a base leg and a pair of side legs, said side legs defining a longitudinal slot therebetween;

a splice base having first and second legs angled relative to one another, said first leg defining a plurality of spaced-apart openings, wherein said splice base is sized and shaped for longitudinal insertion into respective ends of said upright posts, with said first leg of said splice base aligned with said longitudinal slots of said upright posts;

a splice plate defining a plurality of spaced-apart openings that align with said spaced-apart openings of said splice base; and a plurality of fasteners configured for insertion through respective corresponding ones of said spaced-apart openings of said splice base and said splice plate;

wherein said lower upright post is securable to said upper upright post by inserting an upper end of said splice base into said upper upright post, inserting a lower end of said splice base into said lower upright post, arranging said upright posts adjacent one another in end-to-end alignment, and securing said splice plate to said splice base with said fasteners so that a portion of one of said side legs of each of said upright posts is gripped between said splice plate and said splice base.

2. The storage rack post system of claim 1, wherein said splice base has a third leg that is angled relative to said first leg and parallel to said second leg, wherein said third leg is arranged on an opposite side of said first leg from said second leg so that said splice base is generally C-shaped.

3. The storage rack post system of claim 2, wherein said upright posts each define a plurality of spaced-apart openings along each of said side legs, and said second and third legs of said splice base each define a respective plurality of spaced-apart openings that are aligned with said spaced-apart openings of said upright posts.

4. The storage rack post system of claim 2, wherein a portion of each of said side legs of each of said upright posts is gripped between said splice plate and said splice base.

5. A storage rack system comprising:

four of said storage post rack systems of claim 4 in a rectangular arrangement;

a lower support coupled to said lower upright posts of said four storage post rack systems; and an upper support coupled to said upper upright posts of said four storage post rack systems.

6. The storage rack system of claim 5, wherein said upper and lower supports comprise plant trays.

7. The storage rack system of claim 6, further comprising:

a lower front beam supporting a front end of said lower plant tray; and an upper front beam supporting a front end of said upper plant tray;

wherein said front beams of said upper and lower plant trays each comprise water drainage troughs with drain openings.

8. A storage rack post system comprising:

an upper upright post and a lower upright post configured to be stacked end-to-end, wherein each of said upright posts include at least a base leg and a pair of side legs;

a splice base having first and second legs angled relative to one another, said first leg defining a plurality of spaced-apart openings, wherein said splice base is sized and shaped for longitudinal insertion into respective ends of said upright posts, with said first leg of said splice base extends between said side legs opposite said base leg;

a splice plate defining a plurality of spaced-apart openings that align with said spaced-apart openings of said splice base; and a plurality of fasteners configured for insertion through respective corresponding ones of said spaced-apart openings of said splice base and said splice plate;

wherein said lower upright post is securable to said upper upright post by inserting an upper end of said splice base into said upper upright post, inserting a lower end of said splice base into said lower upright post, arranging said upright posts adjacent one another in end-to-end alignment, and securing said splice plate to said splice base with said fasteners so that a portion of each of said side legs of each of said upright posts is gripped between said splice plate and said splice base.

9. The storage rack post system of claim 8, wherein said splice base has a third leg that is angled relative to said first leg and parallel to said second leg, wherein said third leg is arranged on an opposite side of said first leg from said second leg so that said splice base is generally C-shaped.

10. The storage rack post system of claim 9, wherein said upright posts each define a plurality of spaced-apart openings along each of said side legs, and said second and third legs of said splice base each define a respective plurality of spaced-apart openings that are aligned with said spaced-apart openings of said upright posts.

11. The storage rack post system of claim 9, wherein said upright posts are generally C-shaped with said side legs defining a longitudinal slot therebetween.

12. A storage rack system comprising:

four of said storage post rack systems of claim 8 in a rectangular arrangement;

a lower support coupled to said lower upright posts of said four storage post rack systems; and an upper support coupled to said upper upright posts of said four storage post rack systems.

13. The storage rack system of claim 12, wherein said upper and lower supports comprise plant trays.

14. The storage rack system of claim 13, further comprising:

a lower front beam supporting a front end of said lower plant tray; and an upper front beam supporting a front end of said upper plant tray;

wherein said front beams of said upper and lower plant trays each comprise water drainage troughs with drain openings.

* * * * *